US011512938B1

(12) United States Patent
Goss et al.

(10) Patent No.: US 11,512,938 B1
(45) Date of Patent: Nov. 29, 2022

(54) CENTRIFUGAL FUZE ASSEMBLY

(71) Applicant: AURA Technologies, LLC, Raleigh, NC (US)

(72) Inventors: Garrett Goss, Cary, NC (US); Alex Blate, Raleigh, NC (US)

(73) Assignee: AURA Technologies, LLC, Carrboro, NC (US)

( * ) Notice: Subject to any disclaimer, the term of this patent is extended or adjusted under 35 U.S.C. 154(b) by 0 days.

(21) Appl. No.: 17/832,004

(22) Filed: Jun. 3, 2022

Related U.S. Application Data

(60) Provisional application No. 63/196,358, filed on Jun. 3, 2021.

(51) Int. Cl.
*F42C 15/22* (2006.01)

(52) U.S. Cl.
CPC ..... *F42C 15/22* (2013.01)

(58) Field of Classification Search
CPC ..... F42C 15/20; F42C 15/21; F42C 15/22; F42C 15/23
See application file for complete search history.

(56) References Cited

U.S. PATENT DOCUMENTS 1,870,405 A 8/1932 Doe
2,389,383 A 11/1945 Nicholas
2,457,254 A * 12/1948 McCaslin ..... F42C 15/22 102/238
2,541,082 A * 2/1951 McCaslin ..... F42C 15/22 102/233
2,718,850 A * 9/1955 Georges ..... F42C 15/188 102/238
2,967,483 A 1/1961 Junghans et al.
3,124,074 A * 3/1964 Kaiser et al. ..... G04F 3/025 102/248
3,465,676 A * 9/1969 Simmen ..... F42C 15/26 102/233
3,626,853 A * 12/1971 Kraemer ..... F42C 15/188 102/226
3,972,290 A 8/1976 Czajkowski
(Continued)

FOREIGN PATENT DOCUMENTS

WO 2001059400 8/2001

OTHER PUBLICATIONS

Bulent Acar, Modeling Dynamic Behavior of a Safety and Arming Mechanism, May 31, 2017.
(Continued)

*Primary Examiner* — Joshua T Semick
(74) *Attorney, Agent, or Firm* — Danielson Legal LLC

(57) ABSTRACT

Fuze assembly systems, devices, and methods. The fuze assembly includes a baseplate; a first gear operably connected to the baseplate and rotatable about a fixed axis between a safety position and an armed position; and a retention device configured to retain the first gear in the safety position and enable rotation of the first gear while being subject to a centrifugal force above a first threshold from rotation of the assembly. The fuze assembly further includes a second gear in operable contact with the first gear and configured to move along a path of the baseplate due to the centrifugal force to rotate the first gear from the safety position to the armed position.

18 Claims, 7 Drawing Sheets

(56) References Cited

U.S. PATENT DOCUMENTS

| | | | | | |
|---|---|---|---|---|---|
| 4,215,635 | A * | 8/1980 | Farace | F42C 15/188 | 102/238 |
| 4,419,934 | A * | 12/1983 | Apotheloz | F42C 15/26 | 102/233 |
| 4,464,991 | A * | 8/1984 | Kaiser | F42C 15/44 | 102/233 |
| 4,535,695 | A | 8/1985 | Winterhalter | | |
| 4,915,028 | A * | 4/1990 | Apotheloz | F42C 15/44 | 102/246 |
| 6,604,467 | B2 | 8/2003 | Alculumbre et al. | | |
| 8,037,826 | B2 * | 10/2011 | Taylor | F42C 15/26 | 102/222 |
| 8,413,582 | B1 * | 4/2013 | Chen | F42C 15/184 | 102/248 |

OTHER PUBLICATIONS

Ji-Hun Jeong, Junseong Eom, Seung S. Lee, Dong Wan Lim, Yong Ik Jang, Kyoung Woong Seo, Seong Soo Choi, Chun Jae Lee, Jong Soo Oh, Miniature mechanical safety and arming device with runaway escapement arming delay mechanism for artillery fuze, Aug. 15, 2018.

* cited by examiner

CENTRIFUGAL FUZE ASSEMBLY

CROSS REFERENCE TO RELATED APPLICATIONS

The present application claims the benefit of and priority to United States provisional application no. 63/196,358, filed on Jun. 3, 2021, the content of which is hereby incorporated by reference as if set forth in its entirety herein.

STATEMENT REGARDING FEDERALLY SPONSORED RESEARCH OR DEVELOPMENT

"This invention was made with Government support under contract W15QKN-19-C-0005 awarded by the United States Army. The government may have certain rights in the invention.

TECHNICAL FIELD

Embodiments described herein generally relate to projectile devices and methods and, more particularly but not exclusively, to fuzing devices and methods for projectiles.

BACKGROUND

Projectiles such as munitions often use the principle of spin stabilization to improve performance. When fired, the projectile is accelerated axially downrange and is forced to rotate about the same axis. This rotation is typically imparted by a barrel of the weapon, and provides gyroscopic stabilization to the projectile to improve terminal ballistics.

A key requirement for almost all munitions is that they detonate on impact with or in proximity to the intended target. Munitions must also not detonate prematurely, such as during transport, handling, or firing. Munitions are therefore constructed with arming and fuzing mechanisms to achieve detonation downrange and safety up-range.

Existing arming and fuzing mechanisms are complex and involve many precision-designed and manufactured components. The complexity of these mechanisms can make them expensive to produce, and may require specialized tooling and manufacturing techniques.

These existing mechanisms are manufactured by necessity to high tolerances (e.g., on the order of microns) using numerous materials and processes. The components are assembled together in a complicated manner involving multiple, distinct operations. Owing to their complexity, the resultant mechanisms often suffer from significant arm-time variability and unreliability.

A need exists, therefore, for devices and methods that overcome the disadvantages of existing mechanisms.

SUMMARY

This summary is provided to introduce a selection of concepts in a simplified form that are further described below in the Detailed Description section. This summary is not intended to identify or exclude key features or essential features of the claimed subject matter, nor is it intended to be used as an aid in determining the scope of the claimed subject matter.

According to one aspect, embodiments relate to a fuze assembly for a projectile. The fuze assembly includes a baseplate, a first gear operably connected to the baseplate and rotatable about a fixed axis between a safety position and an armed position; a retention device configured to retain the first gear in the safety position and enable rotation of the first gear while being subject to a centrifugal force above a first threshold from rotation of the assembly; and a second gear in operable contact with the first gear and configured to move along a path of the baseplate due to the centrifugal force to rotate the first gear from the safety position to the armed position.

In some embodiments, the fuze assembly further includes a setback pin that is oriented axially with respect to an axis of rotation of the fuze assembly, wherein the setback pin is biased to retain the first gear in the safety position until a forward motion exceeding a second threshold is applied to the assembly.

In some embodiments, the baseplate includes a surface engageable by the second gear during movement of the second gear.

In some embodiments, the fuze assembly further includes a detonator operably positioned to prevent detonation until the first gear is in the armed position and the detonator is moved into operable alignment with an arming mechanism. In some embodiments, the detonator is an electronic or electromechanical detonator, and the arming mechanism and the detonator complete an electrical circuit when the first gear is in the armed position to arm the detonator or the arming mechanism. In some embodiments, the detonator interacts with a firing pin that is configured to strike the arming mechanism when the first gear is in the armed position.

In some embodiments, the first gear has a center of mass and an axis of rotation, wherein the center of mass of the first gear is offset from the axis of rotation of the first gear.

In some embodiments, a portion of the first gear in operable contact with the second gear is shaped as a portion of an ellipse, a portion of an oval, or a portion of a polygon.

In some embodiments, the fuze assembly has a center of mass that is coincident with an axis of rotation of the projectile throughout rotation of the first gear between the safety position to the armed position.

In some embodiments, the baseplate is further configured to asynchronously receive a plurality of first gears or a plurality of second gears of different weights, shapes, or sizes.

In some embodiments, at least one of the baseplate, the first gear, and the second gear are manufactured with a tolerance greater than or equal to ±.001 inches.

According to another aspect, embodiments relate to a method for assembling a fuze for a projectile. The method includes providing a baseplate; operably connecting a first gear to the baseplate, wherein the first gear is rotatable about a fixed axis between a safety position and an armed position; positioning a retention device to retain the first gear in the safety position and enable rotation of the first gear while being subject to a centrifugal force above a first threshold from rotation of the assembly; and operably positioning a second gear with respect to the first gear.

In some embodiments, the method further includes providing a setback pin that is oriented axially with respect to an axis of rotation of the fuze assembly and biased to retain the first gear in the safety position until a forward motion exceeding a second threshold is applied to the fuze.

In some embodiments, the method further includes enabling the second gear to move along a path of the baseplate due to the centrifugal force to rotate the first gear from the safety position to the armed position.

In some embodiments, the method further includes operably positioning a detonator to prevent detonation until the first gear is in the armed position and the detonator is moved into operable alignment with an arming mechanism.

In some embodiments, the first gear has a center of mass and an axis of rotation, wherein the center of mass of the first gear is offset from the axis of rotation of the first gear.

In some embodiments, a portion of the first gear in operable contact with the second gear is shaped as a portion of an ellipse, a portion of an oval, or a portion of a polygon.

In some embodiments, the baseplate is further configured to receive a first gear of a first weight and size, enable an operator to remove the first gear of the first weight and size, and receive a first gear of a second weight and size.

In some embodiments, at least one of the baseplate, the first gear, and the second gear are manufactured with a tolerance greater than or equal to ±.001 inches.

According to yet another aspect, embodiments relate to a method of arming a fuze assembly for a projectile. The method includes imparting a forward velocity to the assembly, the forward velocity causing a pin to move backward to unlock a first gear; and imparting a rotational velocity to the assembly, the rotational velocity exceeding a threshold and thereby causing radial displacement of a detent to permit the first gear to rotate, wherein the rotational velocity further causes a second gear to move along a baseplate a predetermined amount to rotate the first gear to an armed position, wherein the predetermined amount is based on a desired arm time of the projectile.

BRIEF DESCRIPTION OF DRAWINGS

Non-limiting and non-exhaustive embodiments of the invention are described with reference to the following figures, wherein like reference numerals refer to like parts throughout the various views unless otherwise specified.

DETAILED DESCRIPTION

Figure 1:
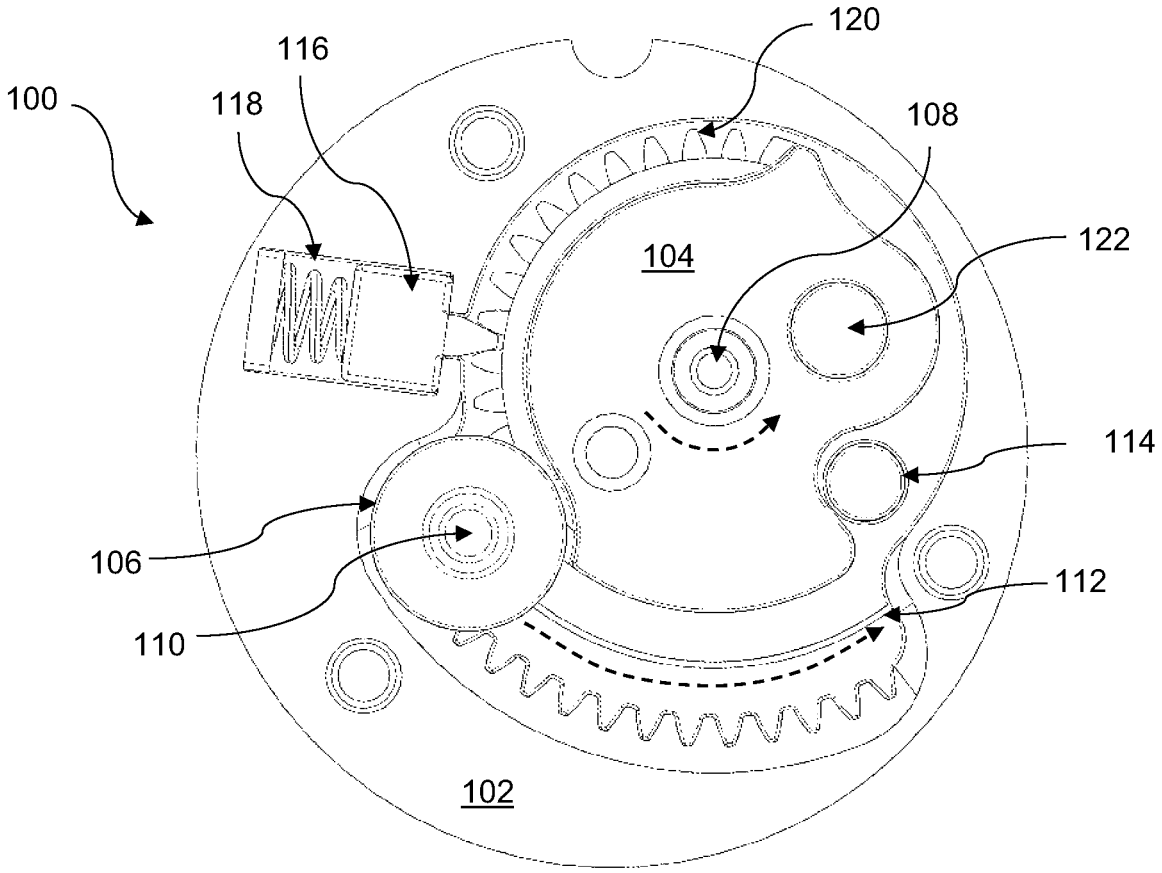
FIG. 1 illustrates a top view of a fuze assembly in a safety position in accordance with one embodiment.

Various embodiments are described more fully below with reference to the accompanying drawings, which form a part hereof, and which show specific exemplary embodiments. However, the concepts of the present disclosure may be implemented in many different forms and should not be construed as limited to the embodiments set forth herein; rather, these embodiments are provided as part of a thorough and complete disclosure, to fully convey the scope of the concepts, techniques and implementations of the present disclosure to those skilled in the art. Embodiments may be practiced as methods, systems or devices. The following detailed description is, therefore, not to be taken in a limiting sense.

Reference in the specification to "one embodiment" or to "an embodiment" means that a particular feature, structure, or characteristic described in connection with the embodiments is included in at least one example implementation or technique in accordance with the present disclosure. The appearances of the phrase "in one embodiment" in various places in the specification are not necessarily all referring to the same embodiment. The appearances of the phrase "in some embodiments" in various places in the specification are not necessarily all referring to the same embodiments.

In addition, the language used in the specification has been principally selected for readability and instructional purposes and may not have been selected to delineate or circumscribe the disclosed subject matter. Accordingly, the present disclosure is intended to be illustrative, and not limiting, of the scope of the concepts discussed herein.

As discussed previously, existing arming and fuzing mechanisms (for simplicity, "fuzing mechanisms") are complex and require several precisely-designed and manufactured components. The complexity of such mechanisms and the required precision makes them expensive to produce. Manufacturing such mechanisms often requires a large number of specialized, dedicated machines and tools. This makes it expensive and difficult to scale production of such mechanisms and can lead to supply chain and logistical risks. Additionally, fuzing mechanisms with a high number of components have more potential points of failure. These existing fuzing mechanisms therefore risk failing to detonate when desired or detonating when not desired.

Some existing fuzing mechanisms are powered largely by electrical or electromechanical means. These types of fuzing mechanisms are therefore susceptible to electromagnetic interferences, pulses, or other phenomena that may affect their performance. Additionally, these types of fuzing mechanisms require batteries or other sources of electrical power that are sensitive to extreme temperatures or other environmental conditions. Additionally, batteries or other types of power sources may be difficult to source, particularly if domestic production is required.

In a mechanical-based fuzing mechanism, a detonator may comprise a small amount of a primary or sensitive explosive, and may be triggered by mechanical means such as by impact of a firing pin or by electrical means such as a bridge-wire or electronic match. Regardless of the type of triggering means, a shockwave from the detonation of the primary explosive triggers the detonation of a high-explosive charge or another insensitive (secondary) explosive.

It is important that the firing pin or equivalent impacts the detonator with sufficient force to trigger the detonator. Similarly, it is important to prevent the firing pin from interacting with the detonator prior to firing, such as during transport or handling, during firing, or otherwise before detonation is desired. Likewise, it is important that electrically-triggered detonators not be energized prior to firing, such as during transport and handling, during firing, or otherwise before detonation is desired.

Embodiments herein provide novel fuzing assemblies and methods. The embodiments herein provide fuze assemblies that may be used in conjunction with a variety of munitions to achieve reliable detonation capabilities. The fuze assemblies herein are more reliable than existing mechanisms and with smaller part counts and looser manufacturing tolerances. As such, the fuze assemblies herein (1) cost less to manufacture than existing devices, (2) can be fabricated using more readily-accessible materials and methods than existing devices, and (3) use fewer components than existing devices. The fuze assemblies herein further do not impact the balance of the projectile and thus improve accuracy compared to existing devices.

The fuze assemblies herein include a baseplate to house or otherwise support a plurality of components. These components may include a first gear that is operably connected to the baseplate and rotatable about a fixed axis between a safety position and an armed position. The fuze assembly may further include a retention device that is configured to retain the first gear in the safety position and enable rotation of the first gear when being subject to a centrifugal force above a first threshold from rotation of the projectile. The fuze assembly may also include a second gear that is in operable contact with the first gear and configured to move along a path of the baseplate due to the centrifugal force of the projectile. This movement of the second gear causes the first gear to rotate from the safety position to the armed position.

The fuze assemblies herein therefore provide multiple safety mechanisms to prevent premature detonation. Additionally, the arrangement and configuration of the various components can delay the arming of the projectile until it is some distance from the muzzle of the firing weapon. Equivalently, the embodiments herein delay arming until the projectile has been subject to a centrifugal force above a threshold for a sufficient amount of time. In other words, the interaction of the first gear, the second gear, and the baseplate regulates the arming distance to some desired value.

The embodiments herein also offer improvements over existing mechanisms by using significantly less precise manufacturing processes. For example, the components of the embodiments herein may be manufactured through additive manufacturing, which is not possible for existing mechanisms due to the required manufacturing tolerances.

Specifically, existing mechanisms specify manufacturing tolerances as small as ±0.0003 inches (about 8 microns). Embodiments described herein, on the other hand, are robust to manufacturing tolerances of at least ±0.001 inches (25.4 microns). Accordingly, the fuze assemblies herein may be cheaper to manufacture than existing mechanisms, as the embodiments herein require fewer components, and the required components have larger manufacturing tolerances than components of existing mechanisms. One of average skill in the art will recognize that prohibitively out-of-tolerance parts may lead to malfunctions in the fuze mechanism, such as premature arming or failure to arm as desired. One of average skill in the art will recognize that parts with looser tolerances are typically cheaper, easier, and faster to produce and inspect.

FIG. 1 illustrates a fuze assembly 100 in accordance with one embodiment. The fuze assembly 100 may be used in or otherwise in conjunction with a variety of munition types. The fuze assembly 100 may include a baseplate 102 supporting a first gear 104 and a second gear 106. The first gear 104 may rotate about a fixed axis 108, and the second gear 106 may rotate about axis 110 and move about the first gear 104 along a path 112.

A setback pin 114 holds the first gear 104 in place when the fuze assembly 100 is at rest or otherwise when the fuze assembly 100 is in a safety state. The first gear 104 is also held in place by a retention device such as a detent 116. The detent 116 is biased towards the first gear 104 by a spring 118 or other biasing mechanism, and engages a geared surface 120 of the first gear 104. Specifically, the detent 116 may engage one or more teeth of the geared surface 120 to prevent the first gear 104 from rotating.

The first gear 104 has a fixed axis of rotation 108 that is offset from the center of the fuze assembly 100. The center of mass of assembly 100 is coincident with the geometric center of assembly 100 and, thus, to the axis of rotation of the projectile to which the fuze assembly is installed.. The center of mass of fuze assembly 100 is substantially invariant over the range of rotation of first gear 104 and the resulting movement of second gear 106.

As discussed above, the first gear 104 may also include one or more arming mechanisms or detonators 122. When the fuze assembly 100 is not in the armed state, the detonator 122 is not in contact with any other components that would initiate detonation. Accordingly, the setback pin 114 and the detent 116 are in a safety or unarmed position in FIG. 1.

Figure 2:
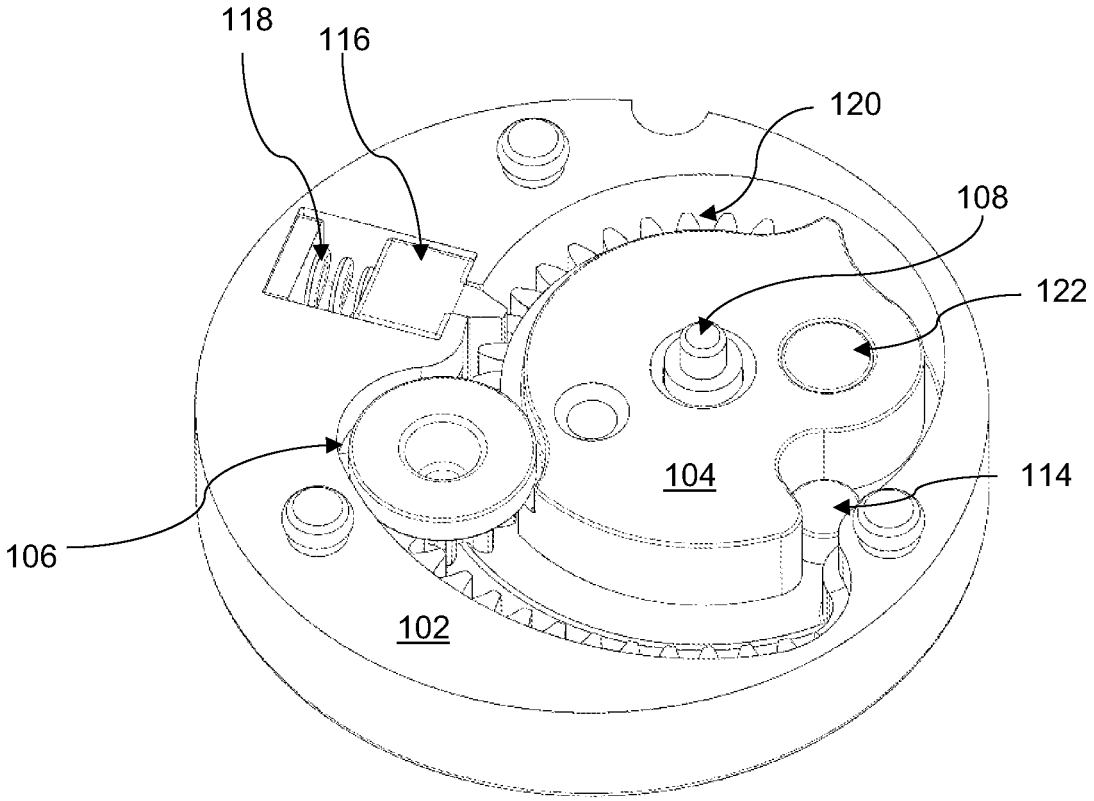
FIG. 2 illustrates a perspective view of the fuze assembly of FIG. 1 in accordance with one embodiment.

FIG. 2 illustrates a perspective view of the fuze assembly 100 of FIG. 1 in accordance with one embodiment. Select components are designated by the same reference numerals as in FIG. 1. As seen in FIG. 2, the setback pin 114 is in an extended position to prevent movement of the first gear 104. For example, the setback pin 114 may be biased to this position via a spring (not shown in FIG. 2) or other mechanism.

Figure 3:
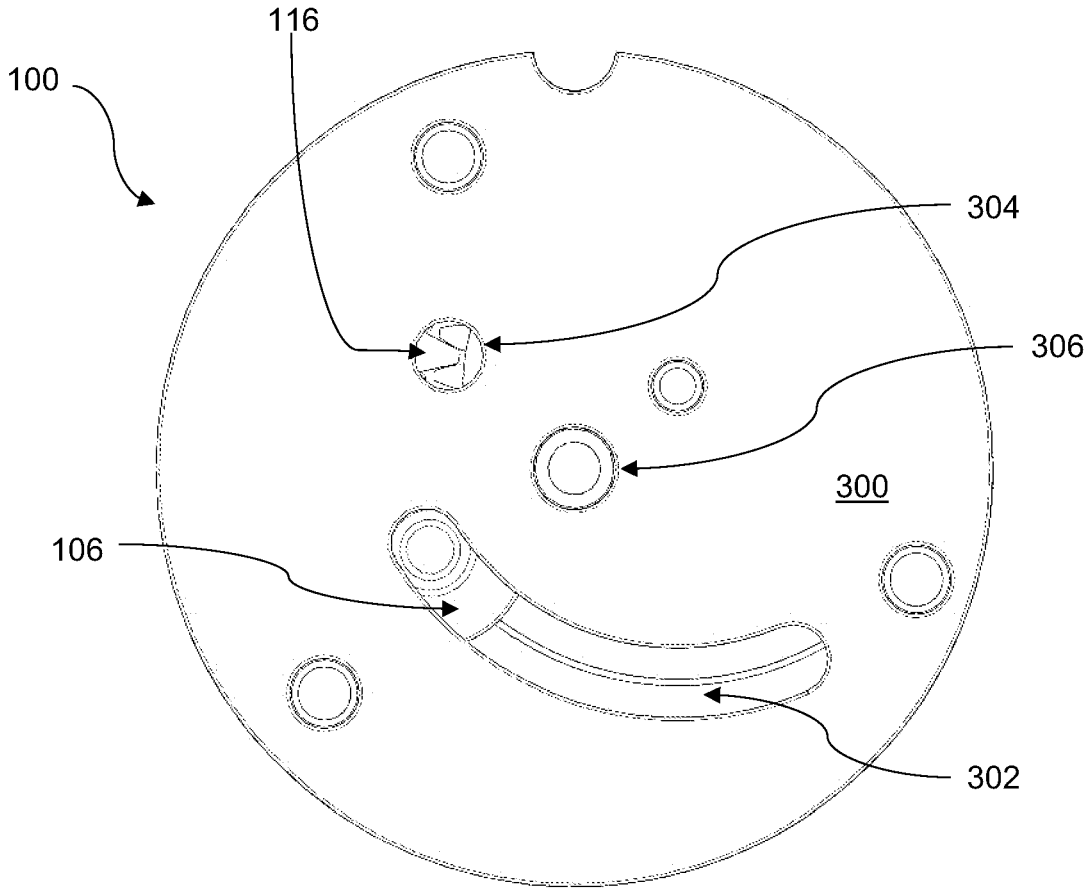
FIG. 3 illustrates a top view of the fuze assembly of FIG. 1 with a cover portion in accordance with one embodiment.

FIG. 3 illustrates a top view of the fuze assembly 100 with a cover portion 300. As seen in FIG. 3, the cover portion 300 includes an opening 302 to facilitate movement of the second gear 106 and an opening 304 to facilitate movement of the detent 116. Openings 302 and 304 may facilitate access to the second gear 106 and the detent 116, respectively, to reset the fuze after post-manufacturing test and inspection.

Upon firing of the projectile, the setback pin 114 retracts from the safety position to an armed position in which it does not prevent movement of the first gear 104. The retraction of the setback pin 114 is at least partly attributable to the forward acceleration of the projectile. Typically, once retracted, setback pin 114 is retained in the armed position and allows movement of the first gear.

Upon firing of the projectile, the fuze assembly 100 is also subject to a rotational movement. As discussed previously, weaponry bores often impart a rotational force on a projectile to improve the ballistics thereof. When the projectile is fired, the rotational force imparted on the projectile and the fuze assembly accelerates the detent 116 outward (i.e., away from the first gear 104). Spring 118 is compressed due to this acceleration so the detent 116 retracts from and unlocks the first gear 104. In the embodiments of the fuze assembly 100 of FIGS. 1-4, the setback pin 114 and the detent 116 are on opposite locations on the fuze assembly 100, thereby reducing the risk that both could be armed accidentally during storage or handling.

The detent 116 will remain in the retracted position during flight as long as the projectile is subject to a rotational force above a threshold. If the projectile ceases to rotate or if its rotation rate drops below the threshold, the detent 116 may re-engage the first gear 104 and prevent the first gear 104 from rotating further.

Figure 4:
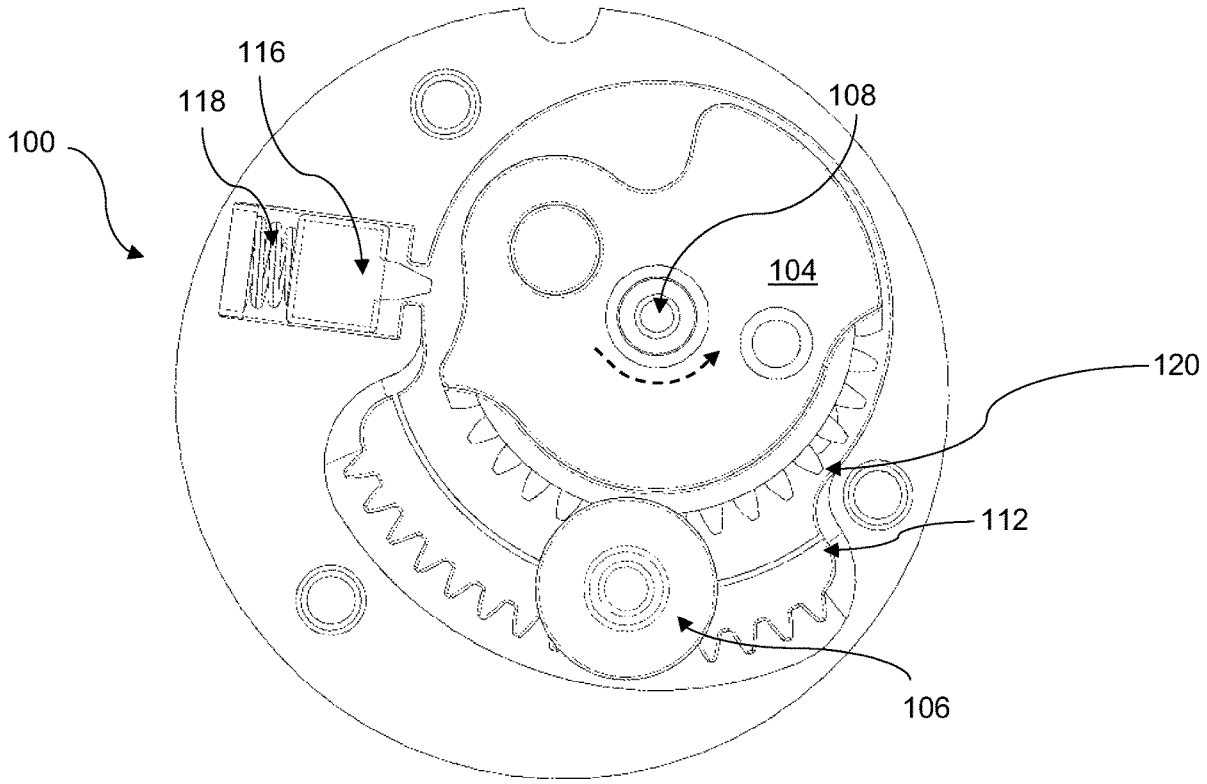
FIG. 4 illustrates a top view of the fuze assembly of FIG. 1 transitioning from a safety position to an armed position in accordance with one embodiment.

FIG. 4 illustrates the fuze assembly 100 during flight (i.e., after firing but before detonation) in accordance with one embodiment. As seen in FIG. 4, the detent 116 is retracted due to the rotational movement of the fuze assembly 100. The setback pin 114 (not shown in FIG. 4) has also retracted. Accordingly, rotation of the first gear 104 is not inhibited.

During flight, the second gear 106 moves along path 112 to move the first gear 104 from the safety position to an armed position. That is, the second gear 106 is pulled outwards along the path 112 by the centrifugal force imparted on the second gear 106 by rotation of the projectile and the fuze assembly 100. The second gear 106 may engage a geared surface of the baseplate 102 (e.g., a "baseplate engagement surface") while moving along the path 112. In some embodiments, centrifugal force on the first gear 104 may or may not contribute to the rotation of the first gear 104 about its rotational axis 108.

The second gear 106 also engages the geared surface 120 of the first gear 104 while the second gear 106 moves along the path 112. This movement therefore causes the first gear 104 to rotate about its axis 108. In other words, in some embodiments, the second gear is in operable contact with the baseplate engagement surface and the first gear over some or all of the range of travel of the second gear. It will be clear to one of ordinary skill in the art that the shape of the baseplate engagement surface and the position thereof with respect to the axis of rotation of the projectile will alter the delay between the firing of the projectile and the fuze entering the armed state.

Figure 5:
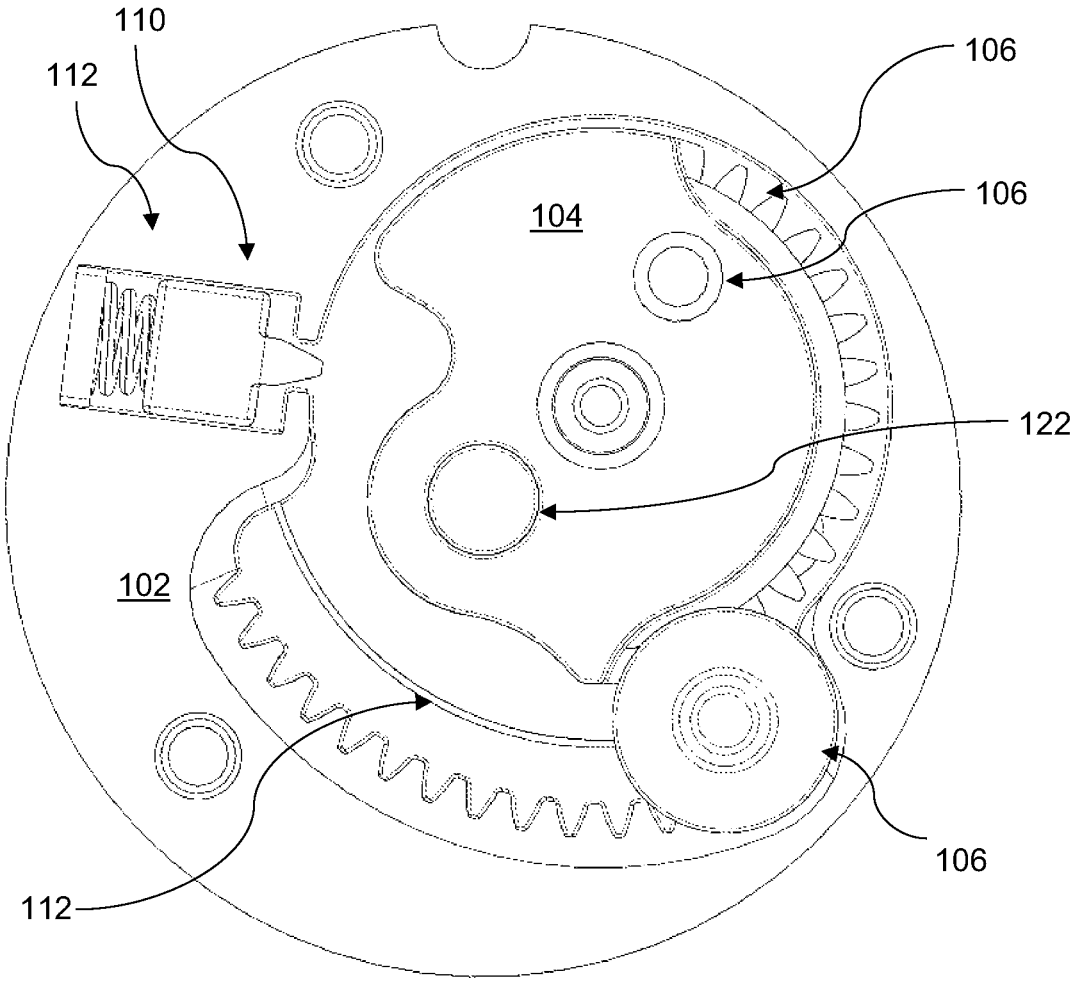
FIG. 5 illustrates a top view of the fuze assembly of FIG. 1 in an armed position in accordance with one embodiment.

FIG. 5 illustrates the fuze assembly 100 in an armed position in accordance with one embodiment. As seen in FIG. 5, the second gear 106 has moved towards the end of the path 112 and is prevented from further movement by the baseplate 102. At this location, the second gear 106 has rotated the first gear 104 a distance sufficient to move the detonator 122 to an armed position. For example, the detonator 122 may contact a firing train or other type of arming mechanism such that, at impact, the detonator 122 initiates a detonation.

In the armed position illustrated in FIG. 5, the detonator 122 is aligned with the geometric center of the baseplate 102, and is also aligned coaxially with hole 306 of the cover plate and an arming mechanism (not shown in FIG. 5). This allows a firing pin (not shown) to interact with detonator 122 and aligns the detonator 122 to interact with downstream explosive components via an arming mechanism discussed below in conjunction with FIG. 6. In other words, the firing pin is configured to strike the detonator when the first gear is in the armed position. In some embodiments, the detonator is external to the fuze assembly, and the first gear allows for operable interaction between the detonator and the arming mechanism and/or firing mechanism only when the first gear is in the armed position. In some embodiments, the detonator is detonated some time after the munition is fully armed such as upon impact with a target.

Figure 6:
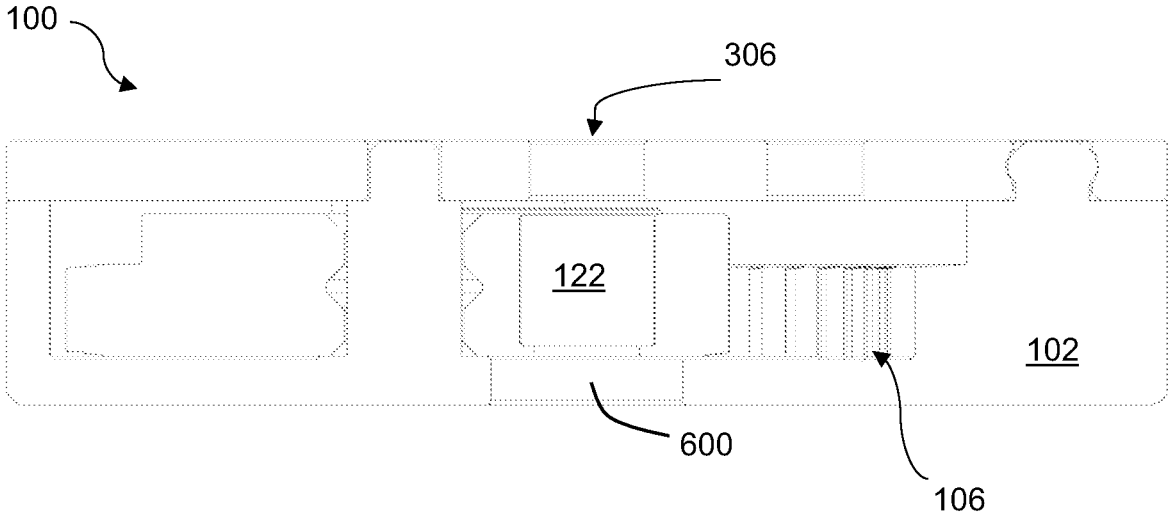
FIG. 6 illustrates a size view of the fuze assembly of FIG. 1 in an armed position in accordance with one embodiment.

FIG. 6 illustrates a side view of the fuze assembly 100 in the armed state in accordance with one embodiment. As seen in FIG. 6, the detonator 122 is aligned with an arming mechanism 600. In some embodiments, arming mechanism 600 is a passage that allows the detonation of the primary explosive of detonator 122 to interact with secondary explosives (not shown) located below the arming mechanism 600.

In accordance with the embodiments herein, the detonator 122 cannot interact with a firing pin or with the arming mechanism 600 unless and until the first gear 104 is in the armed position. One of ordinary skill in the art will recognize that the described embodiments can be used in conjunction with many other configurations of detonators, firing mechanisms, and arming mechanisms and that the embodiment of FIG. 1, et seq, are examples of one class of such configurations.

The detonator 122 and any related arming mechanism or firing train may be configured in a variety of ways. In some embodiments, the detonator 122 may include an electrical component that completes an electrical circuit with an arming mechanism.

In these embodiments, the first gear 104 may further include any appropriate electrically-conductive and electrically-insulating materials to ensure the electrical circuit is not completed until the first gear 104 reaches the armed position. The first gear 104 reaches the armed position once the detonator 122 reaches the firing train and, in these embodiments, completes an electrical circuit.

The detonator may alternatively be mechanically-actuated, such as a percussion cap that is struck by a firing pin when the first gear 104 is in the armed position. In this type of embodiment, the detonator 122 may be installed in or otherwise configured with the first gear 104.

In some embodiments, the first gear 104 may include an aperture or hole that, when the first gear 104 is in the armed position, lines up with a detonator that is mounted in or behind the baseplate 102. In these embodiments, the fuze assembly 100 may further include a firing pin that, when the first gear 104 is in the armed position, passes through this aperture of the first gear 104 to strike the detonator.

In other embodiments, such as electric- or electromechanical-based embodiments, the detonator may be configured as a bridge-wire detonator or an electric match detonator. In these embodiments, the detonator may or may not be installed in the first gear.

Accordingly, the detonator and the firing mechanism may be configured in a variety of ways. The detonator may or may not be installed in or otherwise with the first gear 104. Accordingly, the way in which the fuze assembly is detonated or prevented from being detonated may vary and may depend on the configuration thereof. For example, the fuze assembly may prevent the projectile from detonating by blocking a firing pin, keeping a detonator offset with respect to the firing pin, preventing completion of an electronic circuit, or the like. The configuration of the detonator and associated components may vary and include those available now or invented hereafter as long as the features of the embodiments herein may be accomplished.

In view of the above, the fuze assembly 100 in conjunction with FIGS. 1-6 provides novel and improved fuzing techniques. The arm time of the disclosed fuze assembly can be a function of multiple parameters such as the stiffness of the spring 118, the force required to retract the setback pin 114, the length of the path 112, the gear ratio between the first and second gears, the masses and rotational inertias of the first and second gears, radii of the first and second gears, distance between the axis of rotation of the first gear and that of the projectile, or the like.

Accordingly, the embodiments herein enable the modification one or more of the above-described components to adjust the arm time as desired. The desired arm time may be dependent on the type of projectile, the intended target, the distance between the weaponry firing the projectile and the intended target, etc. The fuze assembly 100 may be modular in nature and allow for the ready replacement of parts to achieve a desired arm time.

The fuze assembly may be resettable, such that it can be tested during manufacture or inspection. For example, the embodiments herein may include openings or slots such as the openings 302 and 304 of FIG. 3 to facilitate resetting of an assembled fuze assembly.

The shapes of the first gear 104 and the second gear 106 shown in FIGS. 1-6 are exemplary. For example, the first gear 104 may have at least a portion of its perimeter shaped as a portion of an ellipse, oval, nautilus, elliptical, polygon, or some other irregular profile. The shape of the gears (or portions thereof) may depend on a number of parameters such as the desired arm time of the fuze assembly. That is, a first gear with a portion that is shaped as an oval may produce an arm time that is different than a first gear with a portion that is shaped as an ellipse. It will be clear to one of ordinary skill in the art that changing the shape of the portion of the first gear that is in or will be in operable contact with the second gear will alter the delay between the firing of the projectile and the fuze assembly entering the armed state.

Additionally, the baseplate may be configured to receive a plurality of first gears or second gears of different weights shapes, or sizes. It will be clear to one of average skill in the art that changing the weights, shapes, or sizes of first or second gears will alter the delay between the firing of the projectile and the fuze assembly entering the armed state.

Although only one setback pin and one detent are shown in FIGS. 1-6, the embodiments herein may use a different number of either of these components. For example, in some embodiments, there may be two detents that are each biased towards the first gear 104 by their own spring. Similarly, the embodiments herein may include multiple setback pins engaging the first gear at various locations to inhibit movement of the first gear 104. The additional safety mechanisms may help prevent undesirable detonation even if one or more of the safety mechanisms fail.

Figure 7:
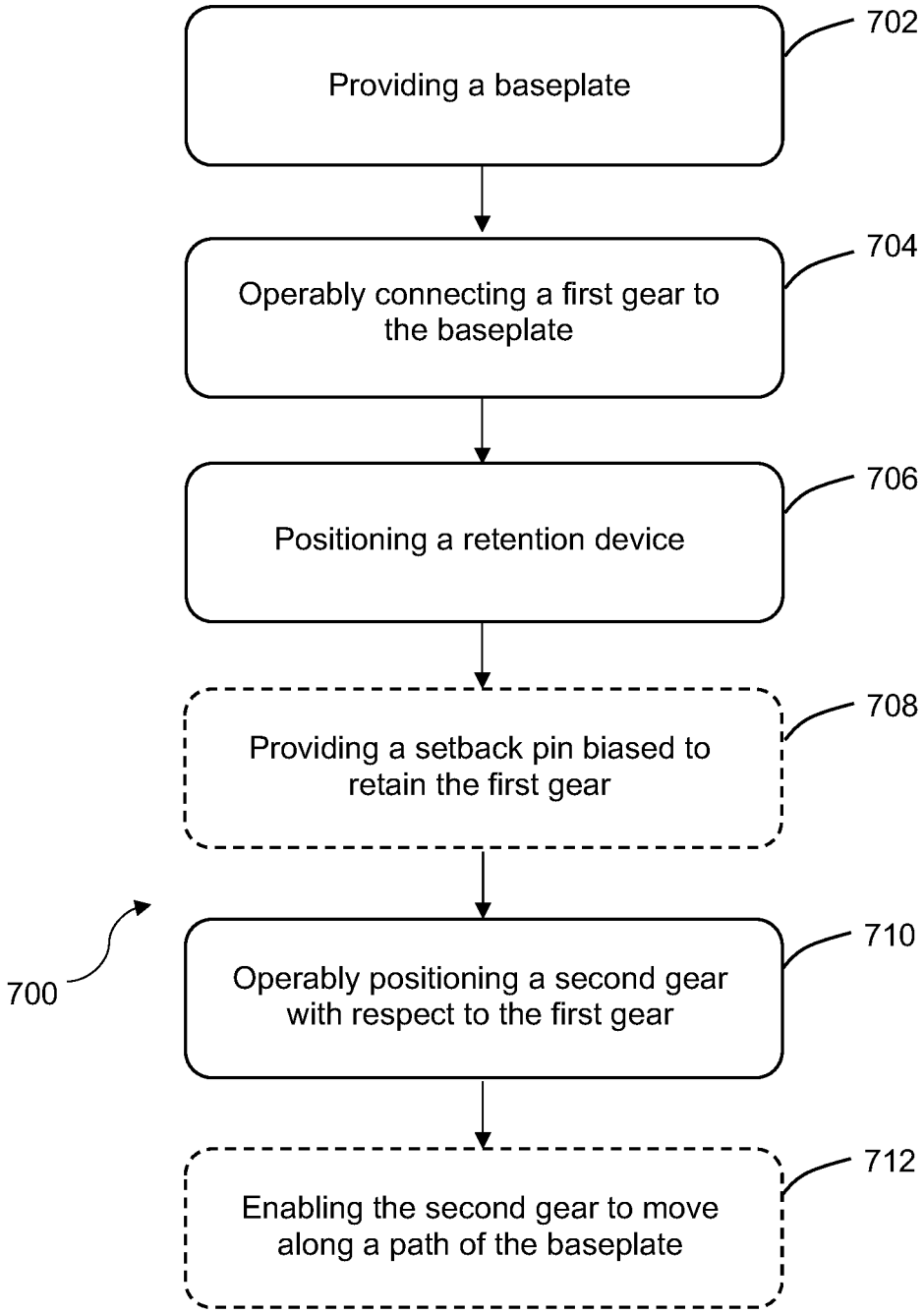
FIG. 7 depicts a flowchart of a method for assembling a fuze for a projectile in accordance with one embodiment.

FIG. 7 depicts a flowchart of a method 700 for assembling a fuze for a projectile in accordance with one embodiment. Step 702 involves providing a baseplate. The baseplate may be similar to the baseplate 102 of FIGS. 1-6 and may be shaped and sized to support various components and to be used in conjunction with a projectile. The shape and size of the baseplate may vary and may depend on the type of projectile with which the fuze assembly will be configured.

Step 704 involves operably connecting a first gear to the baseplate. The first gear may be similar to the first gear 104 of FIGS. 1-6, for example. For example, the first gear may be rotatable about a fixed axis between a safety position and an armed position.

Step 706 involves positioning a retention device to retain the first gear in the safety position and enable rotation of the first gear while being subject to a centrifugal force above a first threshold from rotation of the assembly. The retention device may be similar to the combination of the detent 116 and the spring 118 of FIGS. 1-6, for example.

Step 708 involves providing a setback pin that is oriented axially with respect to an axis of rotation of the fuze assembly and biased to retain the first gear in the safety position until a forward motion exceeding a second threshold is applied to the assembly. The setback pin may be similar to the setback pin 114 of FIGS. 1-6. Upon firing, the forward acceleration of the projectile may cause the setback pin to retract.

Step 710 involves operably positioning a second gear with respect to the first gear. The second gear may be positioned within or on the baseplate as in the embodiments of FIGS. 1-6. For example, the baseplate may include a surface engageable by the second gear during movement of the second gear. The second gear may be similar to the second gear 106 of FIGS. 1-6.

Step 712 involves enabling the second gear to move along a path of the baseplate due to the centrifugal force to rotate the first gear from the safety position to the armed position. Rotational movement of the projectile during flight imparts a centrifugal force on the fuze assembly, thereby causing the second gear to move along a path such as the path 112 of FIGS. 1-6. This movement of the second gear causes the first gear to rotate from the safety position to the armed position.

The movement described in step 712 occurs once or after the setback pin has retracted due to axial force of the projectile and the retention device has retracted due to the force imparted thereon. Until then, the first gear is not able to rotate, which effectively prevents the second gear from moving along the baseplate.

The first gear can rotate only while the projectile, and therefore the fuze assembly, is subject to a rotational velocity at or above a threshold velocity. For example, the fuze assembly would not be rotating at or above the required threshold velocity while at rest or during handling. In these scenarios, neither the setback pin nor the detent would be retracted.

While the fuze assembly is being subject to a rotational velocity at or above a threshold, the retention device retracts and allows the first gear to rotate. As discussed above, the setback pin retracts when the projectile is fired and experiences forward velocity.

In some embodiments, the retention device may re-engage the first gear if the rotational velocity falls below the threshold velocity. This re-engagement would prevent the first gear from continuing to rotate and prevent the fuze assembly from detonating.

The methods, systems, and devices discussed above are examples. Various configurations may omit, substitute, or add various procedures or components as appropriate. For instance, in alternative configurations, the methods may be performed in an order different from that described, and that various steps may be added, omitted, or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Embodiments of the present disclosure, for example, are described above with reference to block diagrams and/or operational illustrations of methods according to embodiments of the present disclosure. The functions/acts noted in the blocks may occur out of the order as shown in any flowchart. For example, two blocks shown in succession may in fact be executed substantially concurrent or the blocks may sometimes be executed in the reverse order, depending upon the functionality/acts involved. Additionally, or alternatively, not all of the blocks shown in any flowchart need to be performed and/or executed. For example, if a given flowchart has five blocks containing functions/acts, it may be the case that only three of the five blocks are performed and/or executed. In this example, any of the three of the five blocks may be performed and/or executed.

A statement that a value exceeds (or is more than) a first threshold value is equivalent to a statement that the value meets or exceeds a second threshold value that is slightly greater than the first threshold value, e.g., the second threshold value being one value higher than the first threshold value in the resolution of a relevant system. A statement that a value is less than (or is within) a first threshold value is equivalent to a statement that the value is less than or equal to a second threshold value that is slightly lower than the first threshold value, e.g., the second threshold value being one value lower than the first threshold value in the resolution of the relevant system.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of various implementations or techniques of the present disclosure. Also, a number of steps may be undertaken before, during, or after the above elements are considered.

Having been provided with the description and illustration of the present application, one skilled in the art may envision variations, modifications, and alternate embodiments falling within the general inventive concept discussed in this application that do not depart from the scope of the following claims.

What is claimed is:

1. A fuze assembly for a projectile, the fuze assembly comprising:

a baseplate;

a first gear operably connected to the baseplate and rotatable about a fixed axis between a safety position and an armed position;

a retention device configured to:

retain the first gear in the safety position, and enable rotation of the first gear while being subject to a centrifugal force above a first threshold from rotation of the assembly;

a second gear in operable contact with the first gear and configured to move along a path of the baseplate due to the centrifugal force to rotate the first gear from the safety position to the armed position; and a setback pin that is oriented axially with respect to an axis of rotation of the fuze assembly, wherein the setback pin is biased to retain the first gear in the safety position until a forward motion exceeding a second threshold is applied to the assembly.

2. The fuze assembly of claim 1 wherein the baseplate includes a surface engageable by the second gear during movement of the second gear.

3. The fuze assembly of claim 1 further comprising a detonator operably positioned to prevent detonation until the first gear is in the armed position and the detonator is moved into operable alignment with an arming mechanism.

4. The fuze assembly of claim 3 wherein the detonator is an electronic or electromechanical detonator, and the arming mechanism and the detonator complete an electrical circuit when the first gear is in the armed position to arm the detonator or the arming mechanism.

5. The fuze assembly of claim 3 wherein the detonator interacts with a firing pin that is configured to strike the arming mechanism when the first gear is in the armed position.

6. The fuze assembly of claim 1 wherein the first gear has a center of mass and an axis of rotation, wherein the center of mass of the first gear is offset from the axis of rotation of the first gear.

7. The fuze assembly of claim 1 wherein a portion of the first gear in operable contact with the second gear is shaped as a portion of an ellipse, a portion of an oval, or a portion of a polygon.

8. The fuze assembly of claim 1 wherein the fuze assembly has a center of mass that is coincident with an axis of rotation of the projectile throughout rotation of the first gear between the safety position to the armed position.

9. The fuze assembly of claim 1 wherein the baseplate is further configured to receive a plurality of first gears or a plurality of second gears, wherein the plurality of first gears and the plurality of second gears of different weights, shapes, or sizes.

10. The fuze assembly of claim 1 wherein at least one of the baseplate, the first gear, and the second gear are manufactured with a tolerance greater than or equal to ±.001 inches.

11. A method for assembling a fuze for a projectile, the method comprising:

providing a baseplate;

operably connecting a first gear to the baseplate, wherein the first gear is rotatable about a fixed axis between a safety position and an armed position;

positioning a retention device to:

retain the first gear in the safety position, and enable rotation of the first gear while being subject to a centrifugal force above a first threshold from rotation of the assembly;

operably positioning a second gear with respect to the first gear; and providing a setback pin that is oriented axially with respect to an axis of rotation of the fuze assembly and biased to retain the first gear in the safety position until a forward motion exceeding a second threshold is applied to the fuze.

12. The method of claim 11 further comprising enabling the second gear to move along a path of the baseplate due to the centrifugal force to rotate the first gear from the safety position to the armed position.

13. The method of claim 11 further comprising operably positioning a detonator to prevent detonation until the first gear is in the armed position and the detonator is moved into operable alignment with an arming mechanism.

14. The method of claim 11 wherein the first gear has a center of mass and an axis of rotation, wherein the center of mass of the first gear is offset from the axis of rotation of the first gear.

15. The method of claim 11 wherein a portion of the first gear in operable contact with the second gear is shaped as a portion of an ellipse, a portion of an oval, or a portion of a polygon.

16. The method of claim 11 wherein the baseplate is configured to:

receive a first gear of a first weight and size;

enable an operator to remove the first gear of the first weight and size; and receive a first gear of a second weight and size.

17. The method of claim 11 wherein at least one of the baseplate, the first gear, and the second gear are manufactured with a tolerance greater than or equal to ±.001 inches.

18. A method of arming a fuze assembly for a projectile, the method comprising:

imparting a forward velocity to the assembly, the forward velocity causing a pin to move backward to unlock a first gear; and imparting a rotational velocity to the assembly, the rotational velocity exceeding a threshold and thereby causing radial displacement of a detent to permit the first gear to rotate, wherein the rotational velocity further causes a second gear to move along a baseplate a predetermined amount to rotate the first gear to an armed position, wherein the predetermined amount is based on a desired arm time of the projectile.

* * * * *